US006528465B1

(12) United States Patent
Cantoro

(10) Patent No.: US 6,528,465 B1
(45) Date of Patent: Mar. 4, 2003

(54) VISCOSITY ENHANCED OPHTHALMIC SOLUTION, HAVING A DETERGENT ACTION ON CONTACT LENSES

(75) Inventor: Amalio Cantoro, Bologna (IT)

(73) Assignee: Laboratoire Medidom S.A., Geneva (CH)

( * ) Notice: Subject to any disclaimer, the term of this patent is extended or adjusted under 35 U.S.C. 154(b) by 0 days.

(21) Appl. No.: 09/937,513

(22) PCT Filed: Mar. 31, 2000

(86) PCT No.: PCT/IB00/00388

§ 371 (c)(1),
(2), (4) Date: Sep. 25, 2001

(87) PCT Pub. No.: WO00/60038

PCT Pub. Date: Oct. 12, 2000

(51) Int. Cl.[7] ..... C11D 1/722; C11D 3/20; C11D 3/26

(52) U.S. Cl. ..... 510/112; 510/421; 510/434; 510/488; 510/510; 134/42; 514/912

(58) Field of Search ..... 510/112, 421, 510/434, 488, 510; 134/42; 514/912

(56) References Cited

U.S. PATENT DOCUMENTS

| | | | | | |
|---|---|---|---|---|---|
| 5,451,303 | A | * | 9/1995 | Heiler et al. | 204/180.1 |
| 5,725,887 | A | * | 3/1998 | Martin et al. | 424/613 |
| 6,030,612 | A | * | 2/2000 | de Faire et al. | 424/94.63 |
| 6,277,365 | B1 | * | 8/2001 | Ellis et al. | 424/78.04 |
| 6,281,192 | B1 | * | 8/2001 | Leahy et al. | 514/8 |
| 6,348,508 | B1 | * | 2/2002 | Denick, Jr. et al. | 514/772.4 |

FOREIGN PATENT DOCUMENTS

| | | | |
|---|---|---|---|
| EP | 0079185 | A | 5/1983 |
| EP | 0381617 | A | 8/1990 |
| EP | 0698388 | A | 2/1996 |
| EP | 0877075 | A | 11/1998 |
| GB | 1340516 | A | 12/1973 |
| WO | WO 9420598 | A | 9/1994 |
| WO | WO 9401414 | A | 1/1995 |
| WO | WO 9500615 | A | 1/1995 |
| WO | WO 9500617 | A | 1/1995 |
| WO | WO 9500620 | A | 1/1995 |
| WO | WO 9906512 | A | 2/1999 |
| WO | WO 99 27060 | A | 6/1999 |

* cited by examiner

*Primary Examiner*—Gregory Delcotto
(74) *Attorney, Agent, or Firm*—Clifford W. Browning; Woodard, Emhardt, Naughton Moriarty & McNett LLP

(57) ABSTRACT

An ophthalmic solution with viscosity enhancing and detergent properties for contact lenses, comprising one or more physiologically acceptably viscosity enhancing agents in aqueous solution having a non-Newtonian rheological behaviour, and one or more physiologically acceptable non-ionic surfactants. The non-ionic surfactant may be selected among esters of fatty acids, sorbitan polyoxyethylates (i.e. polysorbates, such as "Tween"), or block copolymers polyoxyethylene-polyoxypropylene (i.e. poloxamers, such as "Pluronic"). The viscosity enhancing agent may be selected among hyaluronic acid or its salts with alkali or alkaline-earth metals, ethers or esters of cellulose, chitosans, gellans, alginates or carboxyvinyl polymers of the kind Carbopolol® (or carbomer).

9 Claims, No Drawings

VISCOSITY ENHANCED OPHTHALMIC SOLUTION, HAVING A DETERGENT ACTION ON CONTACT LENSES

The present invention relates to a viscosity enhanced ophthalmic solution, having a detergent action on contact lenses. In particular, the invention relates to a preparation in the form of a collyrium to prevent the build up of hydrophobic deposits on contact lenses after having worn them, while maintaining the wettability and transparency, and at the same time to improve the tolerability and reduce the irritating capability thereof.

Any kind of contact lens constitutes a foreign body placed on the ocular surface, the tolerability there of being directly related t o the presence and quality of the preocular lacrimal film. The latter is a complex structure that covers the conjunctiva and the exposed surface of the eyeball, resulting from the co-operation of a solid layer constituted of the complex of the epithelium cornea and glycocalyx (the glycoproteic coating of the epithelial cells, consisting of their secretions), with a liquid layer that consists of the lacrimal film itself. The solid layer has the function of allowing the adherence of the fluid part of the lacrimal film to the ocular surface, while the liquid layer is constituted by three superposed layers, each having a different constitution: a mucous layer, an aqueous layer and a lipid layer.

The internal mucous layer of the fluid lacrimal film is constituted of a mixture of viscoealstic, hydrated glycoproteins (mucin), which represent three quarters of the film and that adhere to the above mentioned solid layer, thus constituting a hydrophilic surface. The aqueous layer is the intermediate portion of the lacrimal film, that is distributed on said hydrophilic surface and that is essentially constituted of water, inorganic and organic salts, sugars, proteins, enzymes and other complex structure biopolymers (such a s the mucins themselves). The substances dissolved in this layer perform structural, osmotic, buffering, nutritional, and defence functions for the lacrimal film with respect to the tissues of the ocular surface. The external lipid layer is constituted of waxes, fatty acids, and cholesterol esters and performs the function of stabilizing the lacrimal film, controlling the water loss caused by evaporation.

The above described three-layer structure constitutes a complex biological system, the main functions of which a re that of protecting the surface of the eye, of maintaining its hydration, lubrication and the cleaning of the cornea surface and as a whole to ensure correct vision. The perfect balance and the continuous renewal of the lacrimal film are necessary conditions so that it may perform these functions. In particular, a constant but not excessive evaporation of water from the ocular surface must be obtained, in order to maintain the osmolarity around the physiological value of about 300 mOsm/l, and the lacrimal film must be continuously re-distributed over the cornea surface as a consequence of blinking. This is more important for wearers of contact lenses, because in this case only a lacrimal film that is stable, sufficiently thick, regularly renewed, with an adequate chemical composition and correct osmolarity, can set-up the correct environment for rendering the contact lens biologically compatible with the ocular surface.

In normal physiological conditions, the production rate of the aqueous portion of tears is, under minimum stimulation conditions, of about 1 $\mu$l/min, while the tear turnover time in rest conditions is of about 16–20 minutes. Such turnover is on the contrary faster under conditions of eye irritation, and very slow in the case of lacrimal hyposecretion. The presence of the contact lens over the ocular surface tends to increase the lacrimal secretion rate as well as the blinking rate.

However, persons having tolerance problems with contact lens tend to increase the secretion rate more slowly or to blink in an incomplete way. With prolonged use, the lens may produce a weakening of the lacrimal film structure (also because of greater evaporation) and, consequently a reduced supply of oxygenated tears to the cornea and a reduction of the tolerability of the lens by the ocular surface.

As a consequence, the reduction of the lacrimal volume available for the ocular surface and/or the presence of an unstable lacrimal film increase the rate of formation of deposits on the ocular surface and on the inner surface of the lens, and these may cause an appreciable reduction of the wettability of the lens itself, thus accelerating the formation of new deposits.

It may be noted that any material that contacts a biological fluid containing proteins is almost immediately covered by a thin protein film; if such film deposited on the lens surface has the time to dry-up between two subsequent blinks, it may be contaminated by lipids constituting the surface layer of the lacrimal film. A hydrophobic area is then set up on the lens surface that is poorly wettable by the lacrimal fluid and which reduces the transparency of the lens over time.

A part of the hydrophobic deposits formed on the lens may be detached and carried away by the rubbing action of the eyelids during the blinking. However the part that adheres to the lens undergoes a protein denaturation following drying and may cause the creation of stable bonds between the deposits and the polymer of which the lens is formed. A undesired feedback is therefore generated, in which the reduced wettability of the lens leads to an increase of the deposits thereon and on the eye, and vice-versa.

As a consequence, the contact lens becomes less transparent and loses its initial optical characteristics. This may not only cause bad vision, but may also be the source of irritation and inflammatory processes of the ocular surface, of progressive intolerance to lenses, of modifications to the conjunctival epithelial structure with a loss of mucous-secreting cells and of allergic phenomena such as giganto-papillar conjunctivitis (GPC).

In order to improve the tolerability of contact lenses and to reduce the feeling of irritation and corneal dryness, usually the same drop-instilled ophthalmic solutions are used, known commonly as artificial tears. The latter are used to treat dry-eye syndrome or dry keratoconjuctivitis, a pathology generally caused by lacrimal senile hyposecretion, or by the use of some systemic drugs. In the simplest case, these preparations have only a moistening action, and are constituted by physiological solutions which are neutral and isotonic with respect to the lacrimal fluid, based only on sodium chloride or on a balanced mixture of several electrolytes. Such formulations achieve the objects of increasing the lacrimal volume, humidifying the ocular surface, diluting the mucus deposits and to a small extent, carrying away debris and foreign bodies. They however have an extremely reduced duration of activity (of the order of few minutes) because the solution is rapidly drained by the conjunctival sac.

In order to overcome the above disadvantages, various formulations of artificial tears have been introduced which are made viscous by means of the addition of high molecular weight agents, usually hydrosoluble polymers of synthetic, semi-synthetic or natural origin. In this respect, it has been experimentally shown that an artificial tear, in order to have a high precorneal permanence time and in order to be at the same time tolerated by the patient, must have properties as close as possible to those of the mucin dispersions, i.e. it must behave as much as possible as a mucomimetic substance. This requires, first of all, a particular non-Newtonian rheologic behaviour, in which the viscosity is not constant, but changes as a function of the shear stress to which the fluid is subjected.

Glycoproteins of the lacrimal fluid in an aqueous solution have a high viscosity in rest conditions, i.e. between two consecutive blinkings and a very low viscosity during a blinking, i.e. when they are subjected to a shear stress. This rheological behaviour typical of non-Newtonian fluids, and in particular of the pseudoplastic ones, lead, on one hand to high precorneal permanence times of the tear in rest conditions, and, on the other hand to an excellent ocular tolerability and the capability of homogeneously redistributing itself on the whole cornea surface as a consequence of blinking.

Only few of the macromolecular products proposed as viscosity enhancing agents for artificial tears are actually capable of showing non-Newtonian behaviour and presently constitute largely used and preferred components. Among these, for instance, are carboxyvinyl polymers such as Carbopol® (also identified with the common name carbomer) included in the formulation in the amount of 0.05–0.25% by weight. The resulting solutions have a non-Newtonian rheologic behaviour usually defined as "plastic" characterised by a threshold tangential strain value under which no flow occurs.

The most widely available viscosity enhancing agents capable of providing solutions having a non-Newtonian rheologic behaviour are, however, macromolecular compounds of natural origin and among these, in first place, the cellulose derivatives (in particular cellulose esters such as carboxymethyl cellulose, and cellulose ethers, such as methylcellulose and their alcoholic derivatives, such as hydroxypropyl cellulose and hydroxypropyl methylcellulose) and the glycosamino-glicanes (in particular hyaluronic acid possibly in its salt form). The latter is a polysaccharide of natural origin that is present in many tissues and fluids both human and animal, widely used in ophthalmic preparations because of the marked pseudoplastic behaviour of its aqueous solutions.

All the above described artificial tear preparations, however, even if they are capable of limiting eye irritation, dryness, and the presence of foreign bodies typical of both dry eye and intolerance reactions to contact lenses, while having a certain "lubricating" action during blinking, do not treat in any way the problem concerning contact lens wearers, of the build-up of hydrophobic deposits on the lens with a consequent reduction of its wettability. As noted above, this problem not only generates a progressive loss of transparency of the contact lens, but renders the above mentioned tolerability problems more serious, starting an undesired feedback in which the increase of the residues deposited on the lens further reduces its wettability.

The problem of surface cleanliness of contact lenses has until now been dealt with only outside of the eye, with several preparations having a detergent, disinfecting and wetting action, to be used on the lenses only after having taken them out. Such preparations that usually contain suitable surfactants in addition to buffers, preservatives and possibly other auxiliary agents such as thickeners or viscosity enhancers, are introduced as washing solutions for contact lenses and do not foresee direct application on the ocular surface.

It is an object of this invention to provide an improved ophthalmic solution that overcomes some or all of the above mentioned disadvantages.

WO-A-95/01414 discloses a single aqueous solution for cleaning, disinfecting and rinsing contact lenses outside of the eye which may comprise a viscosity enhancing agent such as a cellulose derivative in addition to an anti-microbial agent such as a triquaternary phosphate ester and a non-ionic surfactant having cleaning activity such as a poloxamer.

EP-A-0 079 185 discloses a cleaning composition for contact lenses, for use outside of the eye, which may comprise a cellulose derivative as a viscosity enhancing agent in addition to a non-ionic surfactant having cleaning activity such as a poloxamer and a reduced quantity of chlorhexidine.

EP-A-0 698 388 discloses an aqueous ophthalmic composition for use as artificial tears containing hyaluronate as a viscosity thickener having a non-Newtonian rheological behaviour.

GB-A-1 340 516 discloses an aqueous ophthalmic composition having a cleaning activity for contact lenses comprising viscosity enhancing agents such as a polyethylene oxide in addition to a cellulose derivative, which may further comprise a non-ionic surfactant such as a poloxamer for providing product stability.

WO-A-95/00617 discloses an aqueous composition for cleaning and wetting contact lenses, which may be applied directly in the eye, comprising a non-ionic surface active agent having cleaning activity for contact lens deposits such as a poloxamer and a silicone polymer containing an alkyleneoxide side chain for alleviating the irritation potential of the composition, which may further comprise a cellulose derivative as a wetting agent.

WO-A-95/00620 discloses an aqueous composition for cleaning and wetting contact lenses, which may be applied directly in the eye, which comprises a non-ionic surfactant having cleaning activity for contact lenses deposits such as a poloxamer and a polyethylene-oxide-containing material having a hydrophile-lipophile balance HLB of at least about 18 for alleviating the irritation potential of the composition, which may comprise a cellulose derivativea as a wetting agent.

In the present invention, a formulation for topical ophthalmic use is proposed, in which the viscosity enhancing action typical of known artificial tears is associated with a deterging action on the lens during its use, by means of the inclusion in the formulation of suitable surfactants to be applied directly on the ocular surface.

The surfactants that may be used for the purposes of the invention pertain specifically to the class of non-ionic surfactants, widely used in the pharmaceutical field because of their limited aggressiveness and of a satisfactory ratio between the deterging effect and the level of irritation. Moreover, notwithstanding that the direct application of a surfactant on ocular mucoses may be reasonably considered as irritating, the association according to the invention and the contemporaneous presence of the viscosity enhancing agent, having mucomimetic and mucoadhesive properties, renders the proposed detergent formulation unexpectedly well tolerated.

In particular, the present invention provides a viscosity enhanced and detergent ophthalmic solution for contact lenses comprising one or more physiologically acceptable viscosity enhancing agents in aqueous solution having a non-Newtonian rheological behaviour, and one or more physiologically acceptable non-ionic surfactants.

The non-ionic surfactants useful for practising the invention generally include all those already known in the pharmaceutical field, among which are, in particular, ethers of fatty alcohols and of oligoglucosides (such for instance the alkyl polyglycosides known under the name "Triton™"), esters of fatty acids and sorbitan (such as the "Span™"), esters of fatty acids and glycerine (such as the glycerine mono/distearate or the glycerol monolaurate) as well as the ethoxylated non-ionic surfactants having polyoxyethylene chains in the molecule and specifically the polyoxyethylated fatty acids and sorbitan esters (i.e., polysorbates such as the "Tween™"), esters of fatty acids with polyoxyethylene (such as the stearates of polyoxyethylene), the ethers of fatty alcohols with polyoxyethylene (such as polyoxyethylated lauryl ether), ethers of alkylphenoles with polyoxyethylene (for instance the polyoxyethylated octylphenol), and polyoxyethylene-polyoxypropylene block copolymers (also known as poloxamers, such as "Pluronic™"). Particularly preferred for the tolerability detergent power of the resulting formulations are polysorbates, such as polysorbate 80 or Tween™ 80, and poloxamers, such as pluronic™ F-127 (or poloxamer 407), pluronic™ F-68 (or poloxamer 188) and pluronic™ F-87 (or poloxamer 237).

The viscosity enhancing agents with rheological non-Newtonian behaviour of the invention may contain one or more physiologically acceptable macromolecular compounds selected among hyaluronic acid and salts thereof with alkali or alkaline-earth metals, cellulose ethers, such as methyl-cellulose, ethyl cellulose, hydroxypropyl cellulose, hydroxypropyl methylcellulose (HPMC) esters of the same, such as carboxymethyl cellulose (CMC), as well as natural polysaccharide products such as chitosans, gellans, alginates and carboxyvinyl polymers such as Carbopol® (or carbomer).

One or more agents for the adjustment of tonicity which provides the solution with to the correct osmolarity value may be added to the collyrium preparations based on the association of a viscosity promoting agent and of a surfactant agent according to the invention. To this end, products commonly used in the pharmaceutical industry such as sodium or potassium chloride, mannitol, sorbitol, dextrose, boric acid or other salts of alkali metals such as phosphates and citrates, may be used.

Other components that may be added, similarly to what is already known in general for collyria, are acids or bases for pH adjustment, as well as buffers. Specifically, the buffers should bring the pH to values included between 4 and 8. For instance, the viscosity enhancing and cleaning solution may be buffered with any of the buffers well known in the pharmaceutical industry for ophthalmic use, for instance a phosphate buffer or a trizma buffer (tri-hydroxymethyl-aminomethane) in order to have a physiological pH corresponding to 7.0–7.4.

According to some specific embodiments of the invention, the proposed formulation contains sodium hyaluronate as viscosity enhancing agent and poloxamer as non-ionic surfactant, in quantities between 0.005% and 0.50% in weight for the sodium hyaluronate and between 0.010% and 2.0% in weight for the poloxamer. A group of preferred compositions includes the following components in the quantities shown below (the percentages being in weight):

| | |
|---|---|
| sodium hyaluronate | 0.005–0.50% |
| poloxamer 407 | 0.010–2.0% |
| sodium chloride | 0.10–0.90% |
| dibasic sodium phosphate 12 $H_2O$ | 0.010–0.10% |
| phosphoric acid | q.s. to pH = 7.3 |
| bidistilled water | q.s. to 100% |

Taking into account the fact that detergent solutions based on non-ionic surfactants are already known for use in the cleaning of contact lenses outside of the eye, and that such solutions could, for reasons different from those related to the present invention, contain excipients with viscosity enhancing characteristics, a further feature of the present invention is the use of an ophthalmic solution containing one or more physiologically acceptable viscosity enhancing agents having, in aqueous solution, a non-Newtonian rheologic behaviour and one or more physiologically acceptable non-ionic surfactants for the production of an ophthalmic preparation for the cleaning of contact lenses during the use. Such ophthalmic preparation has preferably the above mentioned optional characteristics, that are the subject of the dependent claims.

In the following, some specific embodiments of the invention will be disclosed by way of non-limiting examples together with the results of experiments performed on the proposed viscosity enhancing and deterging solution in comparison with other solutions having a different composition.

EXAMPLES

A Viscous-cleaning Ophthalmic Solution Based on Sodium Hyaluronate and Poloxamer 407 (pluronic™ F-127)

A particularly useful formulation according to the invention and performance of which have been the object of the experimentation briefly referred to in the following, has the following composition (the percentages are expressed in weight):

| | |
|---|---|
| sodium hyaluronate | 0.050% |
| poloxamer 407 | 0.500% |
| sodium chloride | 0.90% |
| dibasic sodium phosphate 12 $H_2O$ | 0.012% |
| phosphoric acid | q.s. to pH = 7.3 |
| bidistilled water | q.s. to 100% |

The above referred to solution, identified as MDV-22, has been subjected to a series of studies and comparison tests in order to evaluate firstly its compatibility with commercial contact lenses of various kinds, and secondly its effectiveness for the proposed aims and its tolerability in comparison with solutions without either the viscosity enhancing agent or the surfactant, as well as a physiological solution. Some of the results of the performed experiments are detailed herebelow.

Tests of Physical-chemical Compatibility with Contact Lenses

In order to evaluate the compatibility of contact lenses (both soft or rigid) with the viscous-cleaning ophthalmic MDV-22 solution according to the invention, comparing it with a physiological solution at 0.9% of sodium chloride in bidistilled water (identified as SOL-F in the tests), four kinds of contact lenses of the firm Soleko (Italy) have been used: three kinds of hydrophilic soft lenses containing 38%, 55% and 70% of water respectively (identified in the following as SOL-38, SOL-55 and SOL-70) and a kind of gas-permeable rigid lens (identified as SOL-RGP). The groups of treated contact lenses for each experiment were constituted of 10 lenses in the case in which the MDV-22 solution was used and of 5 lenses if the physiological solution (SOL-F) was used.

The parameters of the contact lenses subjected to evaluation were light transmittance and surface aspect, including the identification of possible defects.

a. Study of Reversible Modifications

The possible induction of reversible modifications in the contact lenses as a consequence of treatment with the two solutions under comparison has been evaluated with the following procedure: (a) lenses being tested were kept at equilibrium with the control physiological solution (SOL-F) and after this 1st evaluation of the parameters under consideration was performed; (b) subsequently the lenses were kept in contact with the ophthalmic MDV-22 solution, or once more with the comparison SOL-F for 150 minutes (soft lenses) or for 48 hours (rigid gas-permeable lenses), and at the end of the indicated period a 2nd evaluation of the parameters is performed; (c) then the MDV-22 is again substituted with SOL-F (or with SOL-F itself in the case of comparisons) and immediately the final evaluation is performed (3rd evaluation).

The results of the above-described experiments with respect to light transmittance are summarized in the following table.

TABLE 1

Evaluation of reversible modifications: light transmittance

| Lenses | Number | Treatment | Evaluation | Transmittance (%) ± S.D.* |
|---|---|---|---|---|
| SOL-38 | 10 | MDV-22 | 1st | 98.0 ± 0.3 |
| | | | 2nd | 97.9 ± 0.5 |
| | | | 3rd | 97.6 ± 0.5 |
| SOL-38 | 5 | SOL-F | 1st | 98.0 ± 0.4 |
| | | | 2nd | 97.7 ± 0.2 |
| | | | 3rd | 97.5 ± 0.1 |
| SOL-55 | 10 | MDV-22 | 1st | 97.2 ± 0.4 |
| | | | 2nd | 97.7 ± 0.5 |
| | | | 3rd | 97.5 ± 0.3 |
| SOL-55 | 5 | SOL-F | 1st | 98.0 ± 0.3 |
| | | | 2nd | 97.7 ± 0.5 |
| | | | 3rd | 97.5 ± 0.2 |
| SOL-70 | 10 | MDV-22 | 1st | 95.8 ± 0.3 |
| | | | 2nd | 96.2 ± 0.5 |
| | | | 3rd | 95.7 ± 0.4 |
| SOL-70 | 5 | SOL-F | 1st | 96.1 ± 0.4 |
| | | | 2nd | 95.8 ± 0.3 |
| | | | 3rd | 95.9 ± 0.5 |
| SOL-RGP | 10 | MDV-22 | 1st | 94.9 ± 0.4 |
| | | | 2nd | 95.0 ± 0.5 |
| | | | 3rd | 94.7 ± 0.6 |
| SOL-RGP | 5 | SOL-F | 1st | 95.3 ± 0.3 |
| | | | 2nd | 95.2 ± 0.4 |
| | | | 3rd | 95.3 ± 0.5 |

*Standard Deviation

As can be seen from the data of the above Table, modifications in transparency values for the contact lenses tested have no statistically significant difference nor is there such a difference between the three evaluations (1st, 2nd and 3rd) made in sequence on the lenses treated with MDV-22 solution and on lenses treated with MDV-22 and those treated with SOL-F.

With respect to the evaluation of aspect and of possible defects on the surface of the lenses, no defects were evidenced that may be attributed to treatment with the aforesaid solutions. Scratches and small deformations are considered to be caused by manipulation, and as a matter of fact marks were present to the same degree in both the control group treated with the SOL-F and the test group treated with MDV-22.

b. Study of Irreversible Modifications

The possible induction of irreversible modifications in the contact lenses as a consequence of treatment with the two solutions being compared has been evaluated treating each lens under test with two drops of MDV-22 solution or SOL-F, then putting the lens in contact with the SOL-F for three minutes before repeating treatment with MDV-22 or SOL-F itself. For each lens under test, the sequence has been repeated 30 times, arranging the treatment so that the lens remain out of the SOL-F only for 5 seconds in total. Table 2 shows the results of the evaluation at the end of the described procedure, in terms of light transmittance.

TABLE 2

Evaluation of irreversible modifications: light transmittance

| Lenses | Number | Treatment | Evaluation | Transmittance (%) ± S.D.* |
|---|---|---|---|---|
| SOL-38 | 10 | MDV-22 | Final | 97.5 ± 0.7 |
| SOL-38 | 5 | SOL-F | Final | 97.4 ± 0.3 |
| SOL-55 | 10 | MDV-22 | Final | 97.7 ± 0.6 |
| SOL-55 | 5 | SOL-F | Final | 97.7 ± 0.5 |
| SOL-70 | 10 | MDV-22 | Final | 95.0 ± 0.4 |
| SOL-70 | 5 | SOL-F | Final | 94.9 ± 0.4 |
| SOL-RGP | 10 | MDV-22 | Final | 95.3 ± 0.4 |
| SOL-RGP | 5 | SOL-F | Final | 95.6 ± 0.4 |

*Standard Deviation

In the case of the above described evaluation procedure, no significant difference has been shown with respect to the transmittance of light by the lenses treated with the physiological solution or with the viscous-cleaning ophthalmic solution of the invention.

The examination of possible surface defects of the lenses has shown, as in the previous test, only scratches and small deformations considered to be caused by manipulations, besides the breakage of one lens (of the group treated with SOL-70), this also caused by manipulation.

Studies of Acute Tolerability in Rabbits

The acute ocular tolerability of MDV-22 collyrium has been evaluated in New Zealand whitish rabbits (Charles River, Calco, Italia), in comparison with the physiological solution at 0.9% of sodium chloride (above identified as SOL-F) and with respect to an ophthalmic solution having the same composition of the MDV-22 collyrium, but from which sodium hyaluronate was eliminated (identified in the test as solution MT).

The rabbits were divided in 3 groups of 10 and treated, after the initial acclimatization period, as follows. On the first day 12 instillations of 0.05 ml each were made with the collyria under test at intervals of 30 minutes one from the other in the right fornix of conjunctiva, while the untreated contralateral eye was used as control. The condition of the ocular tissues was evaluated with the Draize test (McDonald, T. O. and Shadduck J. A. Eye Irritation, In: Advances in modern Toxicology, Vol. 4, edited by Marzulli F. M. e Maiback H. I ., John Wiley & Sons, New York 1977, pages 139–181). Observations were made each hour starting from the first administration for 7 hours and then 24, 48 and 72 hours after the last treatment, assigning arbitrary scores to various aspects of the palpebralis and bulbar conjunctiva, of the iris and of the cornea.

As a result of the described test, in respect of the rabbits treated with MDV-22 and with SOL-F no significant reddening of the conjunctiva was reported for the whole duration of the test. On the contrary, 4 of 10 rabbits treated with MT solution devoid of sodium hyaluronate had conjunctival hyperemia at the 6th and 7th hour after the first instillation. With respect to other eye tissues, no edema has been found in any of the treated rabbits, and the status of the iris and cornea appeared normal, as well as the phlegm material that is maintained at normal levels.

The test referred to above confirmed that the presence of hyaluronic acid improves the limited eye tolerance of surfactants. It can be hypothesized that this is a consequence of the rheological and biological properties of the viscosity enhancing polysaccharide polymer which not only has a high water molecule retention characteristic, but also exhibits mucomimetic activity, is mucoadhesive, viscoelastic and may be effective as a corneal riepithelizer.

Clinical Study of Activity and Tolerability

The preparation in the form of collyrium according to the invention has been subsequently subjected to human tests, in order to evaluate not only the effectiveness in restoring and then maintaining the transparency of the contact lenses when these are worn and in maintaining the physiological balance of the lacrimal film, but also the possible effects with respect to intolerance of contact lenses. At the same time, a comparison between the performance of the viscous-cleaning MDV-22 solution and those of two ophthalmic solutions having the same composition but lacking sodium hyaluronate (solution MT) and surfactant (referred to as solution MHA), respectively has been made. As a further comparison, the physiological solution at 0.9% of sodium chloride in bidistilled water (already named SOL-F) has been considered.

The patients included in the study were wearers of either hydrophilic (soft) or gas-permeable rigid (RPG) contact lenses with modifications to the non-invasive break-up time (<10 seconds). The measurement of lacrimal film break-up time after blinking, known as break-up time or BUT, is one of the most widespread methods for detecting modifications of the lacrimal film. The groups of contact lens wearers comprised 5 wearers of hydrophilic lenses and 5 wearers of rigid gas-permeable lenses, and the dosage of the several products under test was of 2 drops 4 times each day, after wearing the contact lenses.

The evaluated parameters relating to the efficacy of the product proposed as viscosity enhancer and detergent for contact lenses were non-invasive BUT (measured with the Keeler Tearscope Plus, an instrument used for the non-invasive evaluation of lacrimal film) and contact lens transparency (measured by means of a computerized slit lamp). The measurement of BUT was made: a) at time 0 i.e. immediately after having worn the contact lens and before the instillation of collyrium, b) 15 minutes after instillation, c) 30 minutes thereafter, and d) 15 days after the beginning of therapy, while the transparency of the lenses was evaluated at 0 and 2 hours after the first instillation.

The results obtained for the two above-mentioned parameters are reported in Table 3 (BUT) and in Table 4 (lens transparency).

TABLE 3

Non-invasive break-up time (BUT) before and after the treatment with the collyria under test

| | | BUT (sec) | | | |
|---|---|---|---|---|---|
| Treatment | kind of lens | 0 | 15' | 30' | 15 days |
| MDV-22 | hydrophilic | 9 ± 1 | 14 ± 2 | 15 ± 1 | 15 ± 2 |
| | RGP | 8 ± 2 | 12 ± 1 | 14 ± 2 | 14 ± 1 |
| MHA | hydrophilic | 7 ± 3 | 10 ± 2 | 14 ± 1 | 11 ± 1 |
| | RGP | 8 ± 2 | 9 ± 1 | 10 ± 1 | 10 ± 2 |
| MT | hydrophilic | 8 ± 1 | 11 ± 1 | 10 ± 1 | 10 ± 2 |
| | RGP | 9 ± 1 | 10 ± 1 | 11 ± 1 | 10 ± 1 |

TABLE 3-continued

Non-invasive break-up time (BUT) before and after the treatment with the collyria under test

| | | BUT (sec) | | | |
|---|---|---|---|---|---|
| Treatment | kind of lens | 0 | 15' | 30' | 15 days |
| SOL-F | hydrophilic | 8 ± 2 | 8 ± 1 | 7 ± 1 | 8 ± 2 |
| | RGP | 7 ± 1 | 8 ± 1 | 8 ± 2 | 9 ± 1 |

TABLE 4

Contact lens transparency (%) before and after treatment with the collyria under test

| | | Transparency (%) ± D.S. | |
|---|---|---|---|
| Treatment | kind of lens | 0 | 2 hours |
| MDV-22 | hydrophilic | 100 ± 5 | 96 ± 6 |
| | RGP | 100 ± 4 | 95 ± 4 |
| MHA | hydrophilic | 100 ± 3 | 70 ± 6 |
| | RGP | 100 ± 5 | 65 ± 7 |
| MT | hydrophilic | 100 ± 4 | 63 ± 8 |
| | RGP | 100 ± 3 | 84 ± 6 |
| SOL-F | hydrophilic | 100 ± 2 | 60 ± 9 |
| | RGP | 100 ± 3 | 58 ± 8 |

As it can be seen from the above data, while the lens transparency (evaluated two hours after wearing the lenses and measured in % with respect to time 0) could be restored with MDV-22 preparations according to the invention, and to some degree with the one based on the surfactant alone (MT), only the MDV-22 preparation allowed, already 15 minutes after the first instillation, to bring the break-up time to physiological values independently from the kind of contact lens.

The parameters that have been evaluated in the same series of tests for the more direct quantification of the tolerability of the product per se and of its capability of improving the lens tolerance by patients, compared with the three formulations MHA (without surfactant), MT (without hyaluronic acid) and SOL-F (physiological), were smarting and feelings of a foreign body, which are two typical symptoms of the unbalanced status of lacrimal film. The evaluations were performed with respect to symptoms both before (at time 0) and after (at 15 days) the beginning of treatment, using in both cases an arbitrary intensity scale from 0 to 3 (0=absent, 1=slight, 2=moderate, 3=strong). The results obtained for the smarting evaluation are set forth in the following Table 5.

TABLE 5

Smarting frequency before and after the treatment with collyria under test

| | | | Frequency | | | |
|---|---|---|---|---|---|---|
| | Smarting | | before (0) | | After (15 days) | |
| Treatment | degree | | No. eyes | % | No. eyes | % |
| MDV-22 | absent | (0) | 12 | 60 | 18 | 90 |
| | slight | (1) | 4 | 20 | 2 | 10 |
| | moderate | (2) | 3 | 15 | 0 | 0 |
| | strong | (3) | 1 | 5 | 0 | 0 |
| MHA | absent | (0) | 11 | 55 | 7 | 35 |
| | slight | (1) | 6 | 30 | 7 | 35 |

TABLE 5-continued

Smarting frequency before and after the treatment with collyria under test

| Treatment | Smarting degree | | Frequency before (0) No. eyes | % | After (15 days) No. eyes | % |
|---|---|---|---|---|---|---|
| | moderate | (2) | 3 | 15 | 4 | 20 |
| | strong | (3) | 0 | 0 | 2 | 10 |
| MT | absent | (0) | 12 | 60 | 9 | 45 |
| | slight | (1) | 4 | 15 | 4 | 20 |
| | moderate | (2) | 3 | 15 | 4 | 20 |
| | strong | (3) | 2 | 10 | 3 | 15 |
| SOL-F | absent | (0) | 13 | 65 | 10 | 50 |
| | slight | (1) | 2 | 10 | 3 | 15 |
| | moderate | (2) | 2 | 10 | 3 | 15 |
| | strong | (3) | 3 | 15 | 4 | 20 |

As it can be seen from Table 5, only the preparation MDV-22 allowed an improvement in the smarting frequency, that ranges from its lowest grade (absent), from 60% to 90%. For all other products, a worsening has been detected: MHA (MDV-22 wherefrom the surfactant was eliminated) ranges from 55% up to 35%, MT (MDV-22 wherefrom the hyaluronate was eliminated) ranges from 60% to 45% and for SOL-F (physiological solution) one goes from 65% to 50%.

The results obtained in the tests with respect to the frequency of feeling a foreign body, evaluated with the same arbitrary scale as above, are detailed in the following Table 6.

TABLE 6

Frequency of the feeling of foreign body before and after the treatment with collyria under test

| Treatment | Feeling of foreign body | | Frequency before (0) No. eyes | % | After (15 days) No. eyes | % |
|---|---|---|---|---|---|---|
| MDV-22 | absent | (0) | 15 | 70 | 20 | 100 |
| | slight | (1) | 3 | 15 | 0 | 0 |
| | moderate | (2) | 2 | 150 | 0 | 0 |
| | strong | (3) | 1 | 5 | 0 | 0 |
| MHA | absent | (0) | 13 | 65 | 10 | 50 |
| | slight | (1) | 4 | 20 | 5 | 25 |
| | moderate | (2) | 1 | 5 | 3 | 15 |
| | strong | (3) | 2 | 10 | 2 | 10 |
| MT | absent | (0) | 12 | 60 | 10 | 50 |
| | slight | (1) | 6 | 30 | 6 | 30 |
| | moderate | (2) | 1 | 5 | 2 | 10 |
| | strong | (3) | 1 | 5 | 2 | 15 |
| SOL-F | absent | (0) | 14 | 70 | 10 | 50 |
| | slight | (1) | 4 | 20 | 4 | 20 |
| | moderate | (2) | 1 | 5 | 3 | 15 |
| | strong | (3) | 1 | 5 | 3 | 15 |

The feeling of foreign body symptom has confirmed the results already evidenced with smarting. Only the MDV-22 preparation after 15 days of treatment (with two drops for 4 times per day) showed an improvement with respect to the basal value: the absence of the symptom ranges in fact from 70% to 100%. With respect to all the other preparations a worsening there has been found: the use of collyrium based on hyaluronic acid (MHA) has reduced the frequency of absence of symptoms from 65% to 50%, for collyrium based on surfactants (MT) from 60% to 50% and for physiological solution (SOL-F) from 70% to 50%.

The above experimental results confirm the effectiveness of ophthalmic solutions according to the invention in maintaining and restoring the wettability of contact lenses, their activity in reducing irritation effects, and the intolerance of lenses themselves.

The present invention has been disclosed with reference to some specific embodiments, but it is to be understood that changes or modifications may be introduced by experts in the field without departing from its scope of protection.

What is claimed is:

1. An ophthalmic solution with viscoscity enhancing and detergent properties for contact lenses, comprising one or more physiologically acceptable viscosity enhancing agents in aqueous solution having a non-Newtonian rheological behaviour, and one or more physiologically acceptable non-ionic surfactants, wherein the viscosity enhancing agent is hyaluronic acid, or its salts with alkali or alkaline earth metals, and the non-ionic surfactant is poloxamer.

2. An ophthalmic solution according to claim 1, further comprising one or more tonicity adjusting agents.

3. An ophthalmic solution according to claim 1, further comprising one or more buffers.

4. An ophthalmic solution according to claim 1, comprising from 0.005% to 0.50% in weight of sodium hyaluronate and from 0.010% to 2.0% in weight of said poloxamer.

5. An ophthalmic solution according to claim 4, containing the following ingredients in the quantities shown (weight percentages):

| | |
|---|---|
| sodium hyaluronate | 0.005–0.50% |
| poloxamer | 0.010–2.0% |
| sodium chloride | 0.10–0.90% |
| dibasic sodium phosphate 12 $H_2O$ | 0.010–0.10% |
| phosphoric acid | q.s. to pH = 7.3 |
| bidistilled water | q.s. to 100%. |

6. A process for cleansing contact lenses during their use, which comprises applying on the ocular surface an ophthalmic preparation comprising one or more physiologically acceptable viscosity enhancing agents in aqueous solution having a non-Newtonian rheological behaviour and one or more physiologically acceptable nonionic surfactants, wherein the viscosity enhancing agents is hyaluronic acid or its salts with alkali or alkaline-earth metals and the non-ionic surfactant is poloxamer.

7. A process according to claim 6, wherein said ophthalmic preparation further contains one or more agents for the adjustment of tonicity and one or more buffers.

8. A process according to claim 6, wherein said ophthalmic preparation contains sodium hyaluronate as viscosity enhancing agent.

9. A process according to claim 8 wherein said ophthalmic preparation comprises from 0.005% to 0.50% in weight of sodium hyaluronate and from 0.010% to 2.0% in weight of poloxamer.

* * * * *